United States Patent [19]

Russell

[11] 4,415,027

[45] Nov. 15, 1983

[54] ACCUMULATOR RECHARGING VALVE

[76] Inventor: Larry R. Russell, 6025 Edgemoor, Suite C, Houston, Tex. 77081

[21] Appl. No.: 389,072

[22] Filed: Jun. 16, 1982

[51] Int. Cl.[3] ..... E21B 34/10; E21B 43/00

[52] U.S. Cl. ..... 166/113; 166/321; 166/330; 166/332

[58] Field of Search ..... 166/113, 240, 319, 321-324, 166/330-332, 334; 251/63.4, 58, 230, 341, 352

[56] References Cited

U.S. PATENT DOCUMENTS 3,292,706 12/1966 Grimmer et al. ..... 166/322

3,830,297 8/1974 Cockrell ..... 166/322

3,986,554 10/1976 Nutter ..... 166/240 X

*Primary Examiner*—Ernest R. Purser

*Assistant Examiner*—Thuy M. Bui

*Attorney, Agent, or Firm*—Carl B. Fox, Jr.

[57] ABSTRACT

Accumulator recharging valve wherein a valve is opened to drain the accumulator, and then the accumulator is recharged through another valve, the valves being operated by pipe string pressure after blanking off the flow passage therethrough by a wireline tool, the valve operations being controlled by a barrel cam whereby the drain valve and recharging valve are alternately opened by pressure cycles in the pipe string.

18 Claims, 5 Drawing Figures

ACCUMULATOR RECHARGING VALVE

BACKGROUND OF THE INVENTION

Some downhole oil field tools include accumulators for holding gas under pressure, the gas pressure being used after the tool is run downhole to actuate one or more tool elements. When an accumulator is used as a part of a downhole oil field tool, it is often desirable to alter the charge pressure of the accumulator while the tool is downhole so that the tool will not have to be brought to the surface for the changing of the charge pressure of the accumulator. Bringing the tool to the surface for recharging of the accumulator at a different pressure would involve a so-called round trip, that is, pulling of the drill string or other pipe from the well, recharging the accumulator at the surface, and then rerunning the tool and drill string back into the well hole. This invention seeks to provide an accumulator recharge valve the use of which will permit recharging of the accumulator while the tool is downhole in the well.

SUMMARY OF THE INVENTION

The accumulator recharge valve according to the invention is a pressure-balanced sleeve valve device, spring biased to block communication between the pipe string bore and the accumulator. The recharging operation is performed using string internal pressure manipulation together with a wire line-run blanking sub. The sleeve valve functions to first bleed off the pressure in the accumulator, and then to recharge the accumulator to a desired pressure. The accumulator recharge valve of this invention is adaptable for use with the accumulator of any downhole tool. In this disclosure, the accumulator recharge valve is illustrated as an integral part of a pressure-controlled expandable blade stabilizer, which is operable by alterations of the internal pipe string pressure from the surface, but the recharge valve may be used with other types of tools having one or more accumulators.

A principal object of the invention is to provide a recharging valve apparatus for use in recharging the accumulator of a well tool while the tool is downhole in the well. Another object of the invention is to provide such an apparatus which includes a pressure balanced sleeve valve. A further object of the invention is to provide such an apparatus which operates by alteration of internal pipe string pressure and through use of a wireline-run blanking sub. Another object of the invention is to provide such an apparatus wherein the precharged accumulator pressure is first bled off and then the accumulator is recharged to a usually different desired pressure. A still further object of the invention is to provide such an apparatus which is simple, easily operated, and dependable.

Other objects and advantages of the invention will appear from the following detailed description of a preferred embodiment of apparatus according to the invention, reference being made to the accompanying drawings.

BRIEF DESCRIPTIONS OF THE DRAWINGS

FIGS. 1A, 1B, and 1C are successive vertical half sections showing successive longitudinal portions of the apparatus, from the top downward.

DESCRIPTION OF THE PREFERRED EMBODIMENT

Figure 1C:
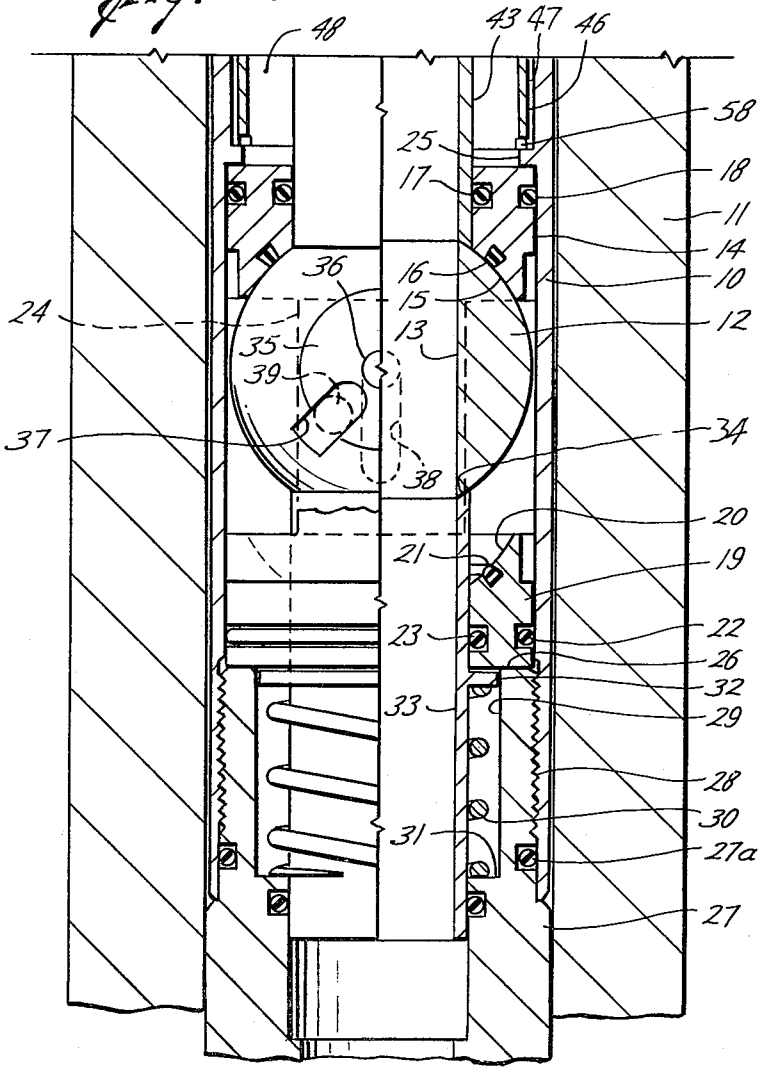

The recharged valve is of generally tubular construction, and is positioned in an elongated ball housing 10 disposed within an upper body 11. Near the lower end of ball housing 10 there is provided a ball valve 12 having a diametric flow port 13 therethrough. An upper seat ring 14 has lower spherically formed seat surface 15 around a groove in which is disposed a circular seal ring 16. Seat ring 14 has inner O-ring seal 17 and outer O-ring seal 18, as shown. A lower seat ring 19 is disposed below ball valve 12 and has upper spherically formed seat surface 20 in a groove around which there is disposed a circular seal 21. O-ring seal 22 and O-ring seal 23 seal around the exterior and the interior of seat ring 19. Seat rings 14, 19 are joined by two oppositely disposed bars 24, one being shown, which are each arcuately formed at their outer surfaces which are disposed against ball housing 10. The inner surfaces of bars 24 are along a cord of the interior curve of valve body 10. Seat ring 14 is disposed at its upper side against a unitary collar 25 formed at the interior of valve body 10, and the lower side of seat ring 19 is disposed against the upper end 26 of a tubular cam body 27, having O-ring seal **27*a* therearound, which is connected to the lower end of ball housing 10 at threaded connection 28. Member 27 is interiorly recessed at 29 to provide a space for helical compression spring 30 therein, the lower end of spring 30 being engaged against shoulder 31 at the lower end of recess 29 and the upper end of spring 30 being disposed against a unitary collar 32 formed around a sleeve 33, the spherically formed upper end 34 of sleeve 33 engaging against the lower side of ball valve 12. Sleeve 33 is biased upwardly against ball valve 12 by the spring 30. Ball valve 12 has a flat 35 at each of opposite sides (one shown), and a short cylindrical bar 36 extends from the center of each flat 35. Each flat 35 includes a slot 37 curved at its inner end and open at its outer end at the outer curvature of the ball valve 12. Each bar 24 has a longitudinal slot 38 therein in which one of the cylindrical bars 36 is slidably disposed. Each bar 24 has a short cylindrical bar 39 protruding therefrom which is slidably engaged within one of the ball slots 37. When ball valve 12 is moved downwardly by downward movement of piston sleeve 43, caused by increased pressure within the tool passage, the ball 12 is caused to rotate by 90° to isolate the flow passage 13, the rotation being caused by action of the two bars, or pins, 39 in the angular slots 37 as the bars 36 move straight down in slots 38. When the ball is returned upward, the ball rotates 90° in the opposite direction to its original position shown in FIG. 1C with passage 13** open, as shown.

There is a narrow annular clearance space between valve body 10 and upper body 11. A port 41 closeable by screwed in plug 42 at the enlarged interiorally threaded outer end of port 41 may be opened to inject oil or other liquid lubricant into the annular clearance space. The piston sleeve 43 is outwardly thickened at its upper end 44 and an O-ring seal 45 is provided between the thickened upper end 44 of piston sleeve 43 and the interior of a sleeve 46. The lower end of sleeve 46 abuts the upper side of collar 25, previously mentioned.

Sleeve 46 has port 46*a* therethrough. The lower end of piston sleeve 43 is spherically formed and is engaged against the upper side of ball valve 12. Sleeve 46 is spaced inwardly of valve body 10, leaving a clearance space 47 of annular shape. O-ring seal 17 seals between the upper seat ring 14 and the lower end of piston sleeve 43. The space between piston sleeve 43 and sleeve 46 provides an annular accumulator space 48 adapted to be filled with a gas under pressure before the lowering of the tool into the well. The ball valve assembly which has just been described and the tool parts therebelow were disclosed in application Ser. No. 368,996, filed Apr. 16, 1982, and the accumulator recharging valve which is the subject matter of this invention extends from collar 25 within ball valve housing 10 and an upper end cap ring 50. End cap 50 has O-ring seals 50*a* and 50*b* and wiper ring 50*c* therearound, and has therethrough a port 51 the upper end of which is enlarged and threaded to receive check valve 52 and threaded plug 53. The accumulator space 48 is initially charged with pressured gas at the surface, before the tool is run into the well, by removal of plug 53 and by injection of pressured gas, e.g. nitrogen gas, through check valve 52 and port 51, to a predetermined selected pressure. The gas injected through check valve 52 and port 51 flows around the sleeves therebelow which are immediately within valve ball housing 10 to enter the accumulator space from its lower end. The lower end of sleeve 46 is notched to permit flow therepast. The upper barrel 54, middle barrel 55, the barrel of sleeve 46 of the recharging valve function together to serve as an outer body for the recharging valve. These barrels 54–55 and 46 have milled flats on their outer peripheries to provide fluid passage therepast within ball valve body 10, and upper barrel 54 and lower barrel 46 have milled end notches 57, 58, respectively, to provide fluid communication from the check valve 52 to the accumulator space 48. Camming pin holder 60, in the form of a sleeve, is screwed into the reduced diameter lower end of upper barrel 54 at threaded connection 61. Inner sleeve 62 serves as the valving means for prohibiting or permitting communication between the drill string bore (the drill string being connected to the upper socket 63 of upper body 11) and the accumulator space 48. Sleeve 62 is provided with a polished bore in its lower end portion 62*a*, where the chevron seals of a wireline-run blanking sub (not shown) can seal against the bore. Locking grooves 64, 65, 66 around the inner periphery of sleeve 62 at its vertical central section are configured to latch and hold a wireline blanking sub based on the general type of landing mandrel shown in the Otis Engineering Corporation catalog appearing in the *Composite Catalog of Oil Field Equipment and Services*, 1980–81, Volume 4, pp. 5972–5973. Use of a Type R or X Otis selective mandrel, with its lower end blanked off to prevent fluid flow, permits landing the mandrel selectively in a particular sleeve 62, even through multiple tools with corresponding sleeves 62 having the same bore diameter but different locking groove patterns) are in the same string.

Figure 1A:
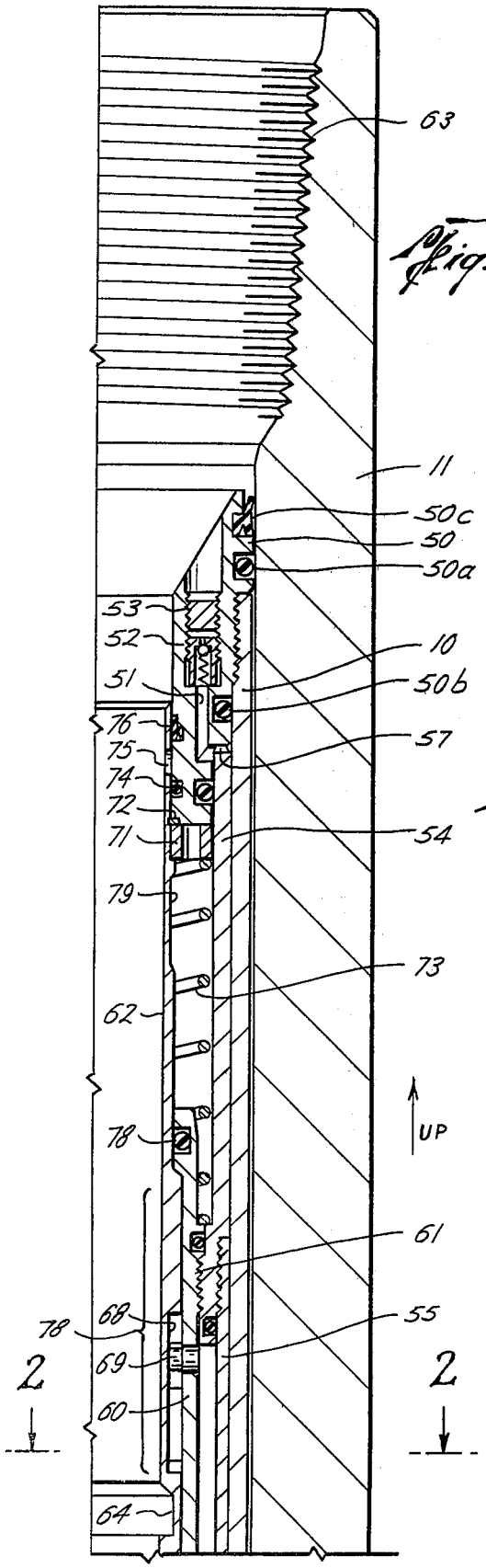
Figure 1B:
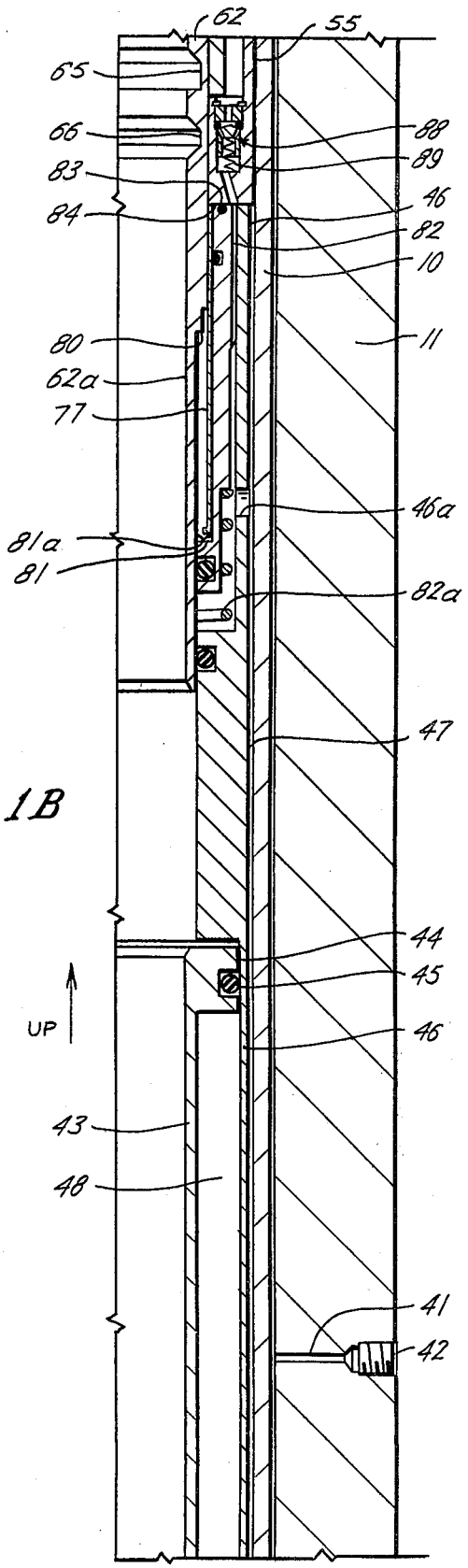
Figure 3:
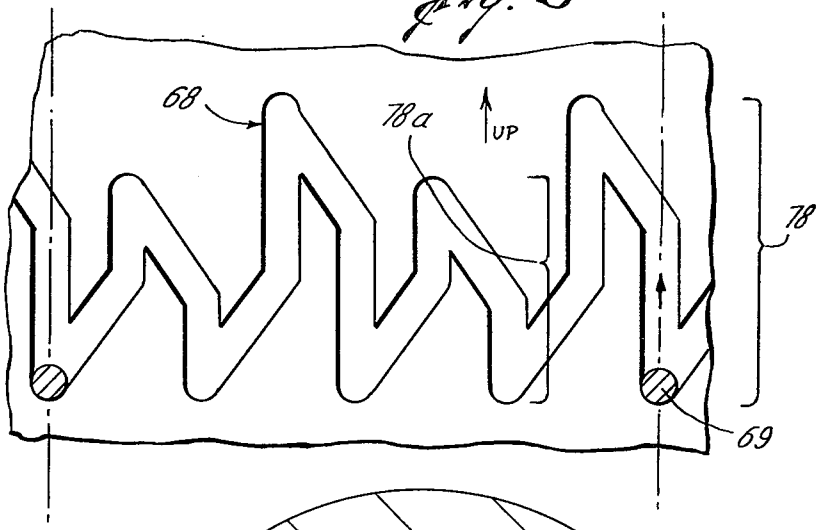
FIG. 3 is a drawing showing the pattern of a barrel cam employed as part of the preferred apparatus.
Figure 2:
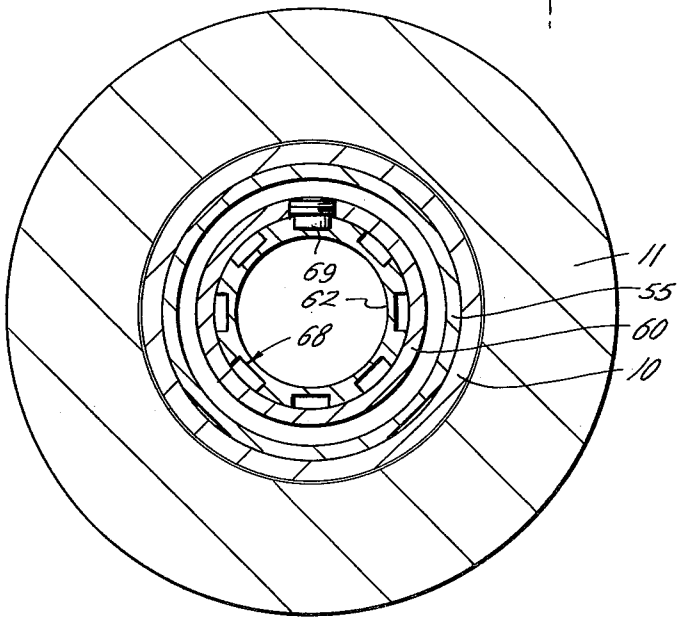
FIG. 2 is a horizontal cross section taken at line 2—3 of FIG. 1A.

The outer diameter of sleeve 62 is provided with a three position barrel cam slot 68. The layed out pattern of barrel cam groove 68 appears in FIG. 3 of the drawings. The barrel cam groove 68 is engaged by camming pin 69 carried by camming pin holder 60.

Sleeve 62 has perforate spring ring 71 attached thereto by Spiralox retaining ring 72, in order to provide a reaction point on the sleeve for biasing the return spring 73. Before the blanking sub is landed inside sleeve 62 at grooves 64–66, the plural circularly spaced ports 75 in the upper end of the sleeve are isolated by O-ring 74 and wiper ring 76. Return spring 73 holds pressure balanced sleeve 62 upward. When the blanking sub is latched into grooves 64–66 of sleeve 62, application of pressure within the drill string above the blanking sub causes sleeve 62 to move downwardly, following the long cam groove course 78 (see FIG. 3). When sleeve 62 is moved downwardly, communication between the drill string flow passage and the annular volume between sleeve 62 and the bores of elements 60, 55, and sleeve 77 is opened when O-ring 78 clears the recessed outer diameter groove 79 of sleeve 62. With sufficient downward movement of sleeve 62, the downwardly-facing shoulder 80 on the outer diameter of sleeve 62 will encounter abutting inner shoulder 81 of dump valve 82 and force seal 83 of dump valve 82 away from its seat 84. Wavy washer 81*a* is disposed abutting shoulder 81. This causes the accumulator 48 precharged pressure to equalize with the drill string pressure above the blanking sub. Sleeve 77 is a sacrificial sleeve which protects the seat 84 of dump valve 82 from flow erosion, since it protrudes past the upper edge of dump valve 82 when the valve is unseated. Release of drill string pressure permits dump valve 82 biased by spring 82*a*, to reseat, while return spring 73 causes sleeve 62 to move back up and to cam around to follow the short stroke groove path 78*a* of slot 68 on the next downward reciprocation of sleeve 62. Slow reapplication of drill string pressure causes sleeve 62 to move downwardly so that fluid communication is established with the poppet check valve assembly 88 mounted in the lower end of middle barrel 55. A very low excess pressure will overcome poppet spring 89 to permit charging the accumulator to the maximum pressure obtained in the drill string before the drill string pressure is bled off. Release of the drill string pressure allows sleeve 62 to return upward as it cams around to the start of another long groove path. After sleeve 62 is returned upward, the wireline blanking sub (not shown) is sheared out and retrieved to the surface. The pressure-balanced spring-biased sleeve valve 62 then remains closed until reactivated by running of another blanking sub and the appropriate pressure cycling.

By way of review, the bore of sleeve valve 62 is closed by a wireline blanking sub latched therein, and the drill string is pressured to move sleeve valve 62 downward according to a long groove path of cam groove 68 until it unseats valve 82 to balance pressure with the accumulator. Next, drill string and accumulator pressure are reduced and valve 82 closes and sleeve valve 62 moves back up when pressure across the blanking sub is approximately balanced. When the drill string pressure is again increased, sleeve valve 62 again is moved down, but not as far since it is controlled by a short groove path of cam groove 68. This time, drill string pressure flows through poppet check valve 88 to recharge the accumulator, after which the wireline blanking sub is sheared out and removed. The above operation may be repeated as necessary.

While a preferred embodiment of apparatus has been described and shown in the drawings, many modifications thereof may be made by a person skilled in the art without departing from the spirit of the invention, and it is intended to protect by Letters Patent all forms of the invention falling within the scope of the following claims.

I claim:

1. Accumulator recharging valve for use in charging a pressure accumulator of a well tool while the well tool is incorporated in a pipe string downhole in a well, comprising a tubular housing disposed within a tubular tool body, a tubular sleeve spaced annularly inward of said tubular housing to form an annular space therebetween, said tubular sleeve having a circular annular gap in its upper portion providing flow communication between the pipe string interior and said annular space when open, control valve means for controllably closing and opening said circular gap, said annular space being divided by partition means at an intermediate point of its axial length into a lower annular accumulator space and an upper annular flow communication space, said gap communicating with said flow communication space, said partition means including bleed valve means for providing flow communication from said accumulator space to said pipe string interior when said control valve means is fully opened, charging valve means for permitting pressured fluid flow from said flow communication space to said accumulator space when the fluid pressure in said flow communication space exceeds the fluid pressure in said accumulator space, cam means for controlling movement of said control valve means whereby said control valve means may be fully opened to cause opening of said bleed valve means and bleeding off of pressure within said accumulator space, and may be partially opened to provide recharging of said accumulator space from said pipe string interior through said flow communication space and said charging valve means while said bleed valve means is closed.

2. The combination of claim 1, said control valve means comprising a sleeve valve bridging said gap to close said gap and adapted to be moved axially to open said gap.

3. The combination of claim 2, said sleeve valve being adapted to receive a wireline blanking sub run from the surface, and being adapted to be moved downward by pipe string pressure applied from the surface when said blanking sub is received therein.

4. The combination of claim 1, said control valve means being a sleeve valve operable by insertion of a wireline blanking sub thereinto and by pressuring of said pipe string above said blanking sub from the surface.

5. The combination of claim 3, said sleeve valve having circular grooves around its interior in which said blanking sub may be latched, and from which said blanking sub may be released by a shearing operation.

6. The combination of claim 5, said bleed valve means comprising a movable sleeve having a sealing ring around its upper end adapted to seat and seal with a downwardly facing surface of the recharging valve housing, said movable sleeve being moved down to unseat said sealing ring from said downwardly facing surface to permit bleeding off of accumulator pressure by engagement therewith by said sleeve valve when said sleeve valve is moved fully downward.

7. The combination of claim 6, said charging valve means comprising a spring biased poppet check valve unseatable by low differential pressure thereacross, whereby only slight elevation of the pipe string pressure above the accumulator space pressure will cause entry of pipe string pressure into said accumulator space, said poppet check valve being exposed to pipe string pressure when said sleeve valve is moved partway down and said bleed valve means remains closed.

8. The combination of claim 7, including barrel cam groove means formed around said valve sleeve, said barrel cam groove means being engaged by a pin carried by the recharging valve housing, the pattern of said cam groove means being such that on alternate downward movements of said sleeve valve said sleeve valve moves fully down to open said bleed valve means, and on other downward movements of said sleeve valve said sleeve valve moves only partway down.

9. The combination of claim 4, said sleeve valve having circular grooves around its interior in which said blanking sub may be latched, and from which said blanking sub may be released by a shearing operation.

10. The combination of claim 9, said bleed valve means comprising a movable sleeve having a sealing ring around its upper end adapted to seat and seal with a downwardly facing surface of the recharging valve housing, said movable sleeve being moved down to unseat said sealing ring from said downwardly facing surface to permit bleeding off of accumulator pressure by engagement therewith by said sleeve valve when said sleeve valve is moved fully downward.

11. The combination of claim 10, said charging valve means comprising a spring biased poppet check valve unseatable by low differential pressure thereacross, whereby only slight elevation of the pipe string pressure above the accumulator space pressure will cause entry of pipe string pressure into said accumulator space, said poppet check valve being exposed to pipe string pressure when said sleeve valve is moved partway down and said bleed valve means remains closed.

12. The combination of claim 11, including barrel cam groove means formed around said valve sleeve, said barrel cam groove means being engaged by a pin carried by the recharging valve housing, the pattern of said cam groove means being such that on alternate downward movements of said sleeve valve said sleeve valve moves fully down to open said bleed valve means, and on other downward movements of said sleeve valve said sleeve valve moves only partway down.

13. Accumulator recharging valve for use in charging a pressure accumulator of a well tool while the well tool is incorporated in a pipe string downhole in a well, comprising a tubular recharging valve housing disposed within the well tool housing, said recharging valve housing having an annular space and an intermediate partition means separating a portion of said annular space to form an accumulator space for holding a fluid under pressure, a first valve for controlling fluid flow between said pipe string and a part of said annular space opposite said partition means from said accumulator space, a second valve for controlling fluid flow from said part of said annular space across said partition means into said accumulator space, a third valve for controlling fluid flow from said accumulator space to said part of said annular space, movement of said first valve from closed to fully opened position causing opening of said third valve to permit bleeding off of accumulator space pressure into said pipe string, movement of said first valve from closed to partly opened position causing fluid flow from said pipe string through said second valve to recharge said accumulator space, and including cam means for causing said first valve to be fully opened on alternate opening movements thereof and to be partly opened on other opening movements thereof.

14. The combination of claim 13, said first valve being a sleeve valve capable of bridging an opening from the pipe string to said part of said annular space when closed and being slidable to open said opening, said second valve being a weakly spring biased poppet check valve, and said third valve being an annular popper valve movable to open by full opening movement of said sleeve valve, said cam means comprising a barrel cam groove around the interior of said sleeve valve engaged by a pin carried by said recharging valve housing.

15. The combination of claim 14, said sleeve valve having interior latch grooves therearound engageable by a wireline inserted tool capable of closing the bore through said sleeve valve whereby said sleeve valve may be moved in one direction by pipe string pressure applied from the surface, said sleeve valve being spring biased in the opposite direction.

16. The combination of claim 15, said inserted tool comprising a blanking sub sealable with the interior of said sleeve valve and latchable in said latch grooves and capable of being sheared therefrom for removal.

17. The combination of claim 16, said sleeve valve being opened by downward movement and closed by upward movement.

18. The combination of claim 17, said recharging valve body comprising an upper tube, a middle tube fixed to said upper tube, and a lower tube abutting said middle tube at its upper end, said second valve being disposed through an inwardly thickened portion of said middle tube at the lower end of said middle tube, said third valve comprising an upwardly spring biased vertical tube disposed within the upper end of said lower tube and having a seal around its upper end adapted to sealingly engage a seat formed by the lower end of said inwardly thickened portion of said middle tube and having an upwardly facing interior shoulder adapted to be engaged by an outer shoulder of said sleeve valve when said sleeve valve is moved fully down, whereby said third valve tube is moved down to separate said upper end seal from said seat, said pin being carried at the interior of a pin support tube fixed to the lower end of said upper tube and extending downward within said middle tube to abut said inwardly thickened portion of said middle tube, said sleeve valve having port means through its upper end, a ring connected to the upper end of said upper tube by a threaded connection, a check valve through said ring through which said accumulator space may be gas pressure charged when the apparatus is at the surface with the charging gas passing to said accumulator space through flow around said upper, middle and lower tubes, said ring having interior seals above and below said port means.

* * * * *